US007211794B2

(12) United States Patent
Malek et al.

(10) Patent No.: US 7,211,794 B2
(45) Date of Patent: May 1, 2007

(54) MASS SPECTROMETER

(75) Inventors: Robert Malek, Lilienthal (DE); Kai Jurgen Meyer, Bremen (DE); Silke Seedorf, Weyhe/Leeste (DE); Stevan Roy Horning, Delmenhorst (DE)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 10/796,645
(22) Filed: Mar. 9, 2004

(65) Prior Publication Data

US 2004/0217284 A1 Nov. 4, 2004

(30) Foreign Application Priority Data

Mar. 10, 2003 (GB) ..... 0305420.2

(51) Int. Cl.
*H01J 49/38* (2006.01)
*H01J 49/26* (2006.01)

(52) U.S. Cl. ..... 250/291; 250/292; 250/281; 250/282; 250/423 R

(58) Field of Classification Search ..... None
See application file for complete search history.

(56) References Cited

U.S. PATENT DOCUMENTS 4,535,235 A * 8/1985 McIver, Jr. ..... 250/282

(Continued)

FOREIGN PATENT DOCUMENTS

GB 2353632 A 2/2001

(Continued)

OTHER PUBLICATIONS

Ghaffari et al., "Experimental Evidence for Chaotic Transport in a Positron Trap", Physical Review Letters, vol. 75, No. 17, Oct. 23, 1995, pp. 3118-3121.

(Continued)

*Primary Examiner*—Nikita Wells

(74) *Attorney, Agent, or Firm*—Haynes & Boone, LLP

(57) ABSTRACT

An improved FT-ICR Mass Spectrometer has an ion source 10 which generates ions that are transmitted through a series of multipoles 20 to an ion trap 30. Ions are ejected from the trap 30, through a series of lens and multipolar ion guide stages 40–90, and into a measurement cell 100 via an exit/gate lens 110. The measurement cell is mounted in a vacuum chamber 240 and this assembly is slideably moveable into a bore of a superconducting magnet 400 which provides the magnetic filed to cause cyclotron motion of the generated ions in the cell 100. By minimising the distance between the source 10 and cell 100, and by careful alignment of the ion optics, the ions can travel at high energies right up to the front of the measurement cell 100.

The cell 100 extends in the longitudinal direction of the magnet bore and is coaxial with that. The ratio of the sectional area of the magnet bore to the sectional area of the cell volume is small (less than 3). The magnet is asymmetric and is relatively short on the ion injection side. The cell 100 is supported from in front of the cell and electrical contact is from the rear thereof.

29 Claims, 7 Drawing Sheets

U.S. PATENT DOCUMENTS

| | | | | |
|---|---|---|---|---|
| 4,686,365 | A * | 8/1987 | Meek et al. | 250/281 |
| 5,389,784 | A * | 2/1995 | Weller | 250/291 |
| 6,720,555 | B2 * | 4/2004 | O'Connor | 250/291 |
| 6,727,699 | B2 * | 4/2004 | Kasten | 324/318 |
| 2002/0079444 | A1 | 6/2002 | Senko | |
| 2004/0217272 | A1 * | 11/2004 | Horning et al. | 250/282 |

FOREIGN PATENT DOCUMENTS

| | | | |
|---|---|---|---|
| JP | 5054852 | A | 3/1993 |
| JP | 9055186 | A | 2/1997 |
| WO | WO 03/060945 | A1 | 7/2003 |

OTHER PUBLICATIONS

PCT Search Report (Form PCT/ISA/210) issued by the European Patent Office in PCT Application No. PCT/EP2004/002486, 7 pages.

Senko, Michael W., et al., "External Accumulation of Ions for Enhanced Electrospray Ionization Fourier Transform Ion Cyclotron Resonance Mass Spectrometry", Journal of the American Society for Mass Spectrometry, vol. 8, pp. 970-976, 1997.

Alford, J.M., et al., "Metal Cluster Ion Cyclotron Resonance: Combining Supersonic Metal Cluster Beam Technology with FT-ICR", International Journal of Mass Spectrometry and Ion Processes, vol. 72, pp. 33-51, 1986.

Senko, Michael W., et al., "Electrospray Ionization Fourier Transform Ion Cyclotron Resonance at 9.4 T", Rapid Communications in Mass Spectrometry, vol. 10, pp. 1824-1828, 1996.

Beu, Steven C., "Fourier-Transform Electrospray Instrumentation for Tandem High-Resolution Mass Spectrometry of Large Molecules", Journal of the American Society for Mass Spectrometry, vol. 4, pp. 557-565, 1993.

Hunter, et al., "An Elongated Trapped-Ion Cell for Ion Cyclotron Resonance Mass Spectrometry with a Superconducting Magnet", International Journal of Mass Spectrometry and Ion Physics, 50 (1983) 259-274.

Naito et al., "Improvement of the Electric Field in the Cylindrical Trapped-Ion Cell", International Journal of Mass Spectrometry and Ion Processes , 120 (1992) 179-192.

Frankevich et al., "Dynamic Ion Trapping in a Cylindrical Open Cell for Fourier Transform Ion Cyclotron Resonance Mass Spectrometry", International Journal of Mass Spectrometry 207 (2001) 57-67.

Partial International Search Report from corresponding International Patent Cooperation Treaty Application No. PCT/EP2004/002486 dated Oct. 6, 2005.

* cited by examiner

MASS SPECTROMETER

PRIOR APPLICATIONS

This application claims priority from Great Britain Application Number 0305420.2, filed Mar. 10, 2003, entitled Mass Spectrometer.

FIELD OF THE INVENTION

The present invention relates to a mass spectrometer and more particularly to a Fourier Transform Ion Cyclotron Resonance Mass Spectrometer.

BACKGROUND OF THE INVENTION

High resolution mass spectrometry is widely used in the detection and identification of molecular structures and the study of chemical and physical processes. A variety of different techniques are known for the generation of a mass spectrum using various trapping and detection methods.

One such technique is Fourier Transform Ion Cyclotron Resonance (FT-ICR). FT-ICR uses the principle of a cyclotron, wherein a high frequency voltage excites ions to move in a spiral within an ICR cell. The ions in the cell orbit as coherent bunches along the same radial paths but at different frequencies. The frequency of the circular motion (the cylcotron frequency) is proportional to the ion mass. A set of detector electrodes are provided and an image current is induced in these by the coherent orbiting ions. The amplitude and frequency of the detected signal are indicative of the quantity and mass of the ions. A mass spectrum is obtainable by carrying out a Fourier Transform of the 'transient', i.e. the signal produced at the detector's electrodes.

An attraction of FT-ICR is its ultrahigh resolution (up to 1,000,000 in certain circumstances and typically well in excess of 100,000). However, to achieve such high resolution, it is important that various system parameters be optimised. For example, it is well known that the performance of an FT-ICR cell seriously degrades if the pressure therein rises above about $2\times10^{-9}$ mbar. This places restrictions on the cell design and upon the magnet that supplies the field to cause the cyclotron motion of the ions. Problems with space charge within the cell (which affects resolution) also affect cell design parameters. Furthermore, when the cell is supplied with ions from an external source, using either electostatic injection to the cell, or using a multipole injection arrangement (see U.S. Pat. No. 4,535,235), it is known that minimization of time of flight effects is desirable.

SUMMARY OF THE INVENTION

The present invention seeks to provide an improved FT-ICR mass analyser arrangement. In particular, the present invention seeks to provide an improved FT-ICR mass analyser geometry, and, additionally or alternatively, improvements to the system for injection of ions into an FT-ICR cell from an external source.

In a first aspect, the present invention provides a measurement cell and magnet arrangement for an ion cyclotron resonance (ICR) mass spectrometer, comprising: a magnet assembly including an electromagnet having a magnet bore with a longitudinal axis, the electromagnet being arranged to generate a magnetic field with field lines that extend in a direction generally parallel with the said longitudinal axis;

and an FT-ICR measurement cell arranged within the bore of the said electromagnet, the cell having cell walls within which is defined a cell volume for receiving ions from an external ion source, the cell extending in the direction of the longitudinal axis of the electromagnet and being generally coaxial therewith; wherein the ratio, R, of the sectional area of the magnet bore to the sectional area of the cell volume, each defined in a plane perpendicular to the said longitudinal axis, is less than 4.25.

Current arrangements of measurement cells and magnets tend to have a significantly higher ratio of magnet bore section to measurement cell section. For example, the previous FT-ICR product sold by the applicant under the product name Finnigan FT/MS has an R value of around 7.

It is known to those skilled in the art that the pressure in a vacuum chamber which contains a measurement cell must be as low as possible—as mentioned in the introduction, typically a pressure above about $2\times10^{-9}$ mbar has a deleterious effect on resolution. It has to date been understood, therefore, that a vacuum chamber for the cell must have a relatively large internal diameter, to minimize restrictions to vacuum pumping. This in turn causes the magnet bore diameter to be relatively large, to accommodate such a vacuum chamber.

On the other hand, a large diameter measurement cell is desirable as this reduces the effect of space charge.

The applicants have discovered that, surprisingly, the larger diameter vacuum chamber can be dispensed with. The ion flux is of the order of $10^{-14}$ grams per second and, therefore, once evacuated to a low pressure, the vacuum chamber receives essentially no source of contamination of the ultrahigh vacuum. Thus it has been realised that the only time where pumping speed is relevant is when the system (vacuum chamber) is initially evacuated.

By minimizing the sectional area of the magnet bore, several advantages are obtained. Firstly, the smaller the magnet bore area, the lower (typically) is the cost of manufacture of such a magnet, particularly in the preferred embodiment where the magnet is a superconducting magnet that operates in a helium bath. The relatively larger measurement cell area for a given magnet bore area also allows space charge effects to be minimized.

In the preferred embodiment, the magnet bore and the measurement cell are each generally right cylindrical. In that case, where the magnet inner diameter is less than 100 mm, the value of R should be less than 4.25, and where the magnet inner diameter is between 100 mm and 150 mm, the value of R may be as low as 2.85 or even less. In the most preferred embodiment, R is 2.983.

There are particular benefits to the combination of a small value of R in combination with a short (in the longitudinal direction) vacuum chamber and magnet. This means that the volume of the vacuum chamber is minimized which reduces initial chamber evacuation time. Most preferably, the distance in the longitudinal direction from the magnetic centre to the end of the magnet in the direction of the incident ions is 600 mm or less.

Preferably, the magnet is asymmetric, that is, the geometric and magnetic centres are not coincident, the length of the magnet to the magnetic centre being kept short on the ion injection side.

The cell is preferably mounted in a vacuum chamber. The cell or chamber is preferably cantilevered or otherwise supported from a point in front (i.e. upstream) of the cell. Previous systems have held the cell from the other side (i.e. from the end opposite to the injection side), since this had previously been considered preferable as the distance to the end flange is then shorter. Most preferably, titanium or a similar resilient, non-magnetic material is employed as a support and in particular a plurality of radially spaced tubes are employed to cantilever the cell and/or vacuum chamber from an upstream structure.

Preferably, the cell and/or vacuum chamber is able to move, e.g. slide on precision rails, into and out of the magnet bore. By mounting electrical contacts on the rear of the cell and by providing corresponding electrical contacts at a fixed point behind the cell, rf power to the cell electrodes can be supplied from the remote (rear) side of the cell. This is beneficial because this allows relatively short electrical leads to be employed which in turn improves the signal to noise ratio. Moreover, wires that carry signals from the detector within the FT-ICR to the signal amplifying and processing stages can be shortened for the same reasons, and this improves the signal to noise ratio for ion detection. Thus, the invention in a preferred embodiment provides for support of the cell from a first, front side with electrical contact from the opposite, rear side, most preferably with a guide for locating the cell as it is inserted into its vacuum housing.

A relatively long cell (e.g. 80 mm) is also preferable in optimising the mass range that can be detected, as is a long homogeneous magnetic field region (e.g. at least 80 mm).

In a further aspect of the present invention, there is provided an ion cyclotron (ICR) mass spectrometer, comprising: an ion source arrangement to generate ions to be analysed; an ion storage device arranged to receive and trap the generated ions; ion optics arranged between the ion source and the ion storage device to focus and/or filter the ions as they pass from the source into the storage device, and an arrangement as recited above, along with ion guide means arranged between the ion storage device and the measurement cell of the cell and magnet arrangement to guide and focus the ions from the ion storage device into the measurement cell for mass spectrometric analysis therein.

In a further aspect of this invention, there is provided a mass spectrometer comprising an ion source for generating ions to be analysed; an ion trapping device to receive the generated ions; ion optics means to guide the ions from the source into the ion trapping device; an FT-ICR mass spectrometer having a measurement cell located within a bore of a magnet, the cell being downstream of a front face of that magnet, the FT-ICR mass spectrometer further comprising detection means to detect ions injected into the measurement cells; ion guiding means arranged between the ion trapping device and the FT-ICR mass spectrometer to guide the ions ejected from the trap into the FT-ICR mass spectrometer for generation of a mass spectrum therein; and a power supply for generating an electric field to accelerate the ions between the ion source and the measurement cell; wherein the power supply is configured to supply a potential which accelerates ions from the source or the ion trapping device to a kinetic energy E and to decelerate the said ions at a location only immediately in front of the measurement cell, and downstream of the front face of the magnet.

A known problem with FT-ICR mass spectrometers is the introduction of time of flight separation of ions as they travel from the ion source to the measurement cell. Broadly, current systems can be divided into two categories.

A first type of ion injection system for FT-ICR is a so-called electrostatic injection system. Here, ions are guided from the ion source by a system of electrostatic lenses to the measurement cell of the FT-ICR. In order to address perceived problems with magnetic reflection, such systems have employed a high electrostatic potential difference and strong electrostatic focussing. Thus, ions are accelerated to high speed by high voltages of up to several hundred volts and then decelerated in the fringe field of the FT-ICR magnet. The potential is set such that electrostatic Einzel lenses focus the ion beam. The ions travel from the last lens of the electrostatic injection system, commonly known as the "free flight zone", at a relatively low kinetic energy of a few electron volts. This distance of low kinetic energy travel may be around 30–40 cm which is around 20–30% of the total distance travelled by the ions. This introduces time of flight effects wherein ions of lighter mass arrive at the cell before ions of heavier mass and may be preferentially trapped in the cell.

In a second arrangement, referred to hereinafter as "multipole injection", an array of multipole ion guides are employed to inject ions from an ion trap into the FT-ICR measurement cell. In order to allow capture in the cell, various trapping schemes are employed, such as gated trapping, exchange of kinetic energy between ions and other particles (collisional trapping), or exchange of kinetic energy between different directions of motion, as is described, for example, in "Experimental Evidence for Chaotic Transport in a Positron Trap" by Gaffari and Conti, Physical Review Letters 75(1995), No. 17, page 3118–3121. In each case, however, the ions must have a small kinetic energy distribution, optimally with a two standard deviation width of less than one electron volts. Without such a small kinetic energy distribution, only a part of the ion beam is trapped.

Thus, with the multipole injection technique, it is common practice to accelerate ions that are emitted from a storage trap (whether 2D or 3D RF-trap, magnetic trap, or otherwise) at very low energies, typically a few electron volts and usually no more than ten electron volts.

The problem with this arrangement is that, whilst ion capture is maximized, mass range is compromised because the time of flight effects increase with overall flight time.

The applicants have found that, by taking every effort to keep the flight distance short and ensuring that ions are carefully guided, high energies can be employed between the source or ion trap all the way through to the measurement cell. For example, the power supply may supply a potential so as to accelerate ions from the ion source and/or the ion trap to a kinetic energy in excess of 20 electron volts, more preferably in excess of 50 electron volts, and most preferably between 50 and 60 electron volts right through the system to the measurement cell. Looked at another way, the ions travel from the ion source, or the ion trap, to the measurement cell at a raised potential for at least 90% of the overall distance. In prior art electrostatic injection systems, as explained above, typically a higher potential is maintained only for 65 to 80% of the total distance from the ion source to the cell. With a typical multipole injection system, the ions do not travel at a raised kinetic energy at all.

Thus, the arrangement of this aspect of the present invention reduces the unwanted time of flight distribution dramatically. As a consequence, the arrangement is able to achieve a mass range of M(high)=10*M(low). In state of the art FT-ICR mass spectrometers having an external source, the mass range is typically M(high)=1.6–3*M(low).

It is beneficial, in order to permit the use of high speed ion injection without widening the kinetic energy distribution, to optimise the geometry of the mass spectrometer arrangement. For example, the use of injection multipoles with small inner radii (typically less than 4 mm, and most preferably less than 2.9 mm) reduces kinetic energy spread.

Those skilled in the art are aware that multipole ion guides operate acceptably even when they are mounted relatively inaccurately. Again, in a preferred embodiment of the present invention, lenses and/or multipoles within the ion guiding means are aligned precisely, and most preferably with a deviation of less than 0.1 mm from optimal values. This likewise has been found to reduce kinetic energy distribution of the ions.

In general terms, to optimise the ion flight path for external injection of ions into an FT-ICR cell, at least one of the following should desirably be considered. In preference, at least 50% of the following features are incorporated in a system embodying an aspect of the present invention.

(a) Multipole ion guides or lens systems should be employed that provide a good focussing of the ion beam from the ion source.

(b) The multipole ion guides and/or lenses should have a small inner diameter and the differential pumping between each stage should be optimised.

(c) Small diameter vacuum pumps may be employed.

(d) The vacuum housing should be optimised to minimise dead space, and this may include slightly bent pumping paths with low or no restriction, to minimize space consumption by pumps and flanges.

(e) The multipole/lens/multipole assembly should be high precision to minimize ion losses under acceleration and to maximize ion transmission to the small lenses.

(f) Ion acceleration should be optimised in preference, since the time of flight distribution reduces with increase in ion speed.

(g) Increasing the length of the measurement cell as much as possible. This preferably requires the following:

(h) The use of a magnet with a long homogeneous region;

(i) A short deceleration zone adjacent the multipole exit lens to convert the bulk of the kinetic energy into potential energy, followed by a long and flat deceleration zone within the cell to remove the last few percent of the kinetic energy;

(j) Minimization of kinetic energy spread of injected ions by cooling in a static or dynamic ion trap, by proper selection and timing of injection potentials, and/or by precise machining of the ion guide system to minimize unforeseen or non-deterministic widening of the energy distribution.

(k) Minimization of the volume of the vacuum chamber in which the measurement cell is mounted, to reduce the pumpable volume.

(l) Optimised alignment of the injection path with the direction of the magnetic field on that injection path (in preference, less than 1° deviation between the direction of the injection path and the direction of the magnetic field).

(m) Finally, it is considered beneficial to maintain the potential of the measurement cell during ion capture as close as possible to the potential of the ion trap which injects the ions into that measurement cell.

The invention also extends to a method of mass spectrometry comprising: (a) at an ion source, generating ions to be analysed; (b) guiding the generated ions into an ion trap; (c) ejecting ions from the ion trap; (d) guiding the ions ejected from the ion trap into an FT-ICR mass spectrometer which has a measurement cell located within a bore of a magnet, the cell being arranged downstream of a front face of that magnet; (e) accelerating the ions from the ion source or the ion trap to the measurement cell of the FT-ICR mass spectrometer; (f) decelerating the ions at a location only immediately upstream of the measurement cell, that location being downstream of the front face of the magnet; and (g) detecting the ions within the measurement cell.

Further preferred features of the present invention will become apparent by reference to the appended claims and from a review of the specific description of a preferred embodiment which follows.

BRIEF DESCRIPTION OF THE DRAWINGS

A preferred embodiment of the present invention will now be described by way of example only and with reference to the following Figures, in which.

DETAILED DESCRIPTION OF A PREFERRED EMBODIMENT

Figure 1:
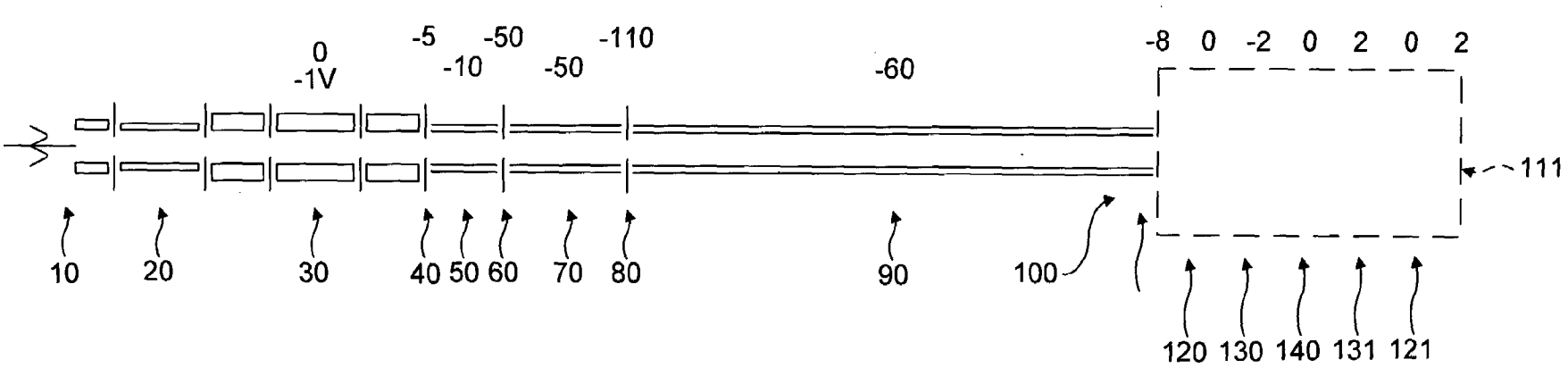
FIG. 1 shows, schematically, a mass spectrometer system including a measurement cell of a Fourier Transform Ion Cyclotron Resonance (FT-ICR) Mass Spectrometer (the magnet for such not being shown in FIG. 1 for the sake of clarity)

Referring first to FIG. 1, a highly schematic arrangement of a mass spectrometer system embodying the present invention is shown.

Ions are generated in an ion source 10, which may be an electrospray ion source (ESI), matrix-assisted laser ion desorption ionisation (MALDI) source, or the like. In preference, the ion source is at atmospheric pressure.

Ions generated at the ion source are transmitted through a system of ion optics such as one or more multipoles 20 with differential pumping. Differential pumping arrangements to transfer ions from atmospheric pressure down to a relatively low pressure are well known as such in the art and will not be described further.

Ions exiting the multipole ion optics 20 enter an ion trap 30. The ion trap may be a 2-D or 3-D RF trap, a multipole trap or any other suitable ion storage device, including static electromagnetic or optical traps.

Ions are ejected from the ion trap 30 through a first lens 40 into a first multipole ion guide 50. From here, ions pass through a second lens 60 into a second multipole ion guide 70, and then through a third lens 80 into a third, relatively longer multipole ion guide 90. The various multipole ion guides and lenses are preferably accurately aligned relative to one another such that there is less than 0.1 mm deviation from optimal values.

In the arrangement of FIG. 1, the inner diameter (defined by the rods in the multipole) of each of the multipole ion guides 50, 70 and 90 is 5.73 mm. The lenses 40, 60 and 80 have an inner diameter, in preference, of 2–3 mm. Employing injection multipoles with small inner radii helps to improve ion injection at high speed without widening the kinetic energy distribution of the ions as they pass through the multipole ion guides. It is furthermore desirable to maintain the ratio of the inner diameter of the lenses to the inner diameter of the multipoles as close to 1 as possible within the constraints of differential pumping. This minimizes the spread of kinetic energy.

At the downstream end of the third multipole ion guide 90 is an exit/gate lens 110 which delimits the third multipole ion guide and a measurement cell 100. The measurement cell 100 is a part of a Fourier Transform Ion Cyclotron Resonance (FT-ICR) Mass Spectrometer. The measurement cell 100 typically comprises a set of cylindrical electrodes 120–140 as shown in FIG. 1, to allow application of an electric field to ions within the cell that, in combination with a magnetic field, causes cyclotron resonance as is understood by those skilled in the art.

The inner diameter of the exit/gate lens 110 is selected to be only slightly smaller than the multipole inner diameter (which is in preference 5.73 mm), because the magnetic guiding field from the FT-ICR magnet (not shown in FIG. 1) at that point is so strong that ions are not "drawn" through the lens as they are in the upstream positions where the magnetic field is relatively negligible.

By using a shielded magnet, the magnetic field at third lens 80 is to all intents 0. A further advantage of such an actively shielded magnet is that it allows high performance turbo pumps to be mounted close to the magnet face so as to provide better pumping and shorter time of flight. Prior instruments used diffusion pumps mounted away from the magnet because the magnetic fields from an unshielded magnet would destroy a pump using rotating parts, and diffusion pumps having a large metal mass could not be mounted too close to the magnet or they would distort the magnetic field.

It is to be understood that, whilst ions may be generated at ion source 10 and travel directly from there into the measurement cell 100, they may instead be ejected from the ion trap 30 for further storage in the first multipole ion guide 50 and subsequent passage from there into the measurement cell 100.

Under typical operating conditions, the pressures within the system of FIG. 1 are atmospheric at the ion source 10, around $10^{-3}$ mbar at the ion trap 30, $10^{-5}$ mbar at the first multipole ion guide 50, $10^{-7}$ mbar at the second multipole ion guide 70 and $10^{-9}$ mbar in the third multipole ion guide and downstream from there (and in the measurement cell 100 in particular). Such a low pressure is important in the measurement cell to maintain good mass resolution.

The kinetic energy of ions in a one of the multipoles 50, 70, 90 is a result of the difference of the initial potential of the ions when they are ejected either from the ion trap 30 or from the first multipole ion guide 50, and the potential in the respective downstream multipole ion guide (50, 70, 90). The kinetic energy of ions in the measurement cell 100 is a result of the difference between the initial potential and the measurement cell potential. Because the electric fields are typically saddle-shaped, the potential at the ion trap 30 or the first multipole ion guide 50 must be slightly above the cell potential defined, for example, by the cylindrical electrode 140 in FIG. 1.

The kinetic energy spread and beam divergence increases with mechanical imprecision of the multipole ion guide and lens assemblies (50–90) the acceleration voltage, and the multipole ion guide diameter. The kinetic energy spread and beam divergence decreases, however, with the strength of the guiding potential. Thus, the increased kinetic energy spread from a higher acceleration voltage can be compensated by proper mechanical alignment and selection of small diameter multipoles with high effective guide potential. The lens alignment and construction of multipole ion guide 90 from two multipoles which are connected and aligned extremely precisely is beneficial. In particular, a tolerance of less than +/−0.5 mm is specified, and less in certain places.

Figure 7:
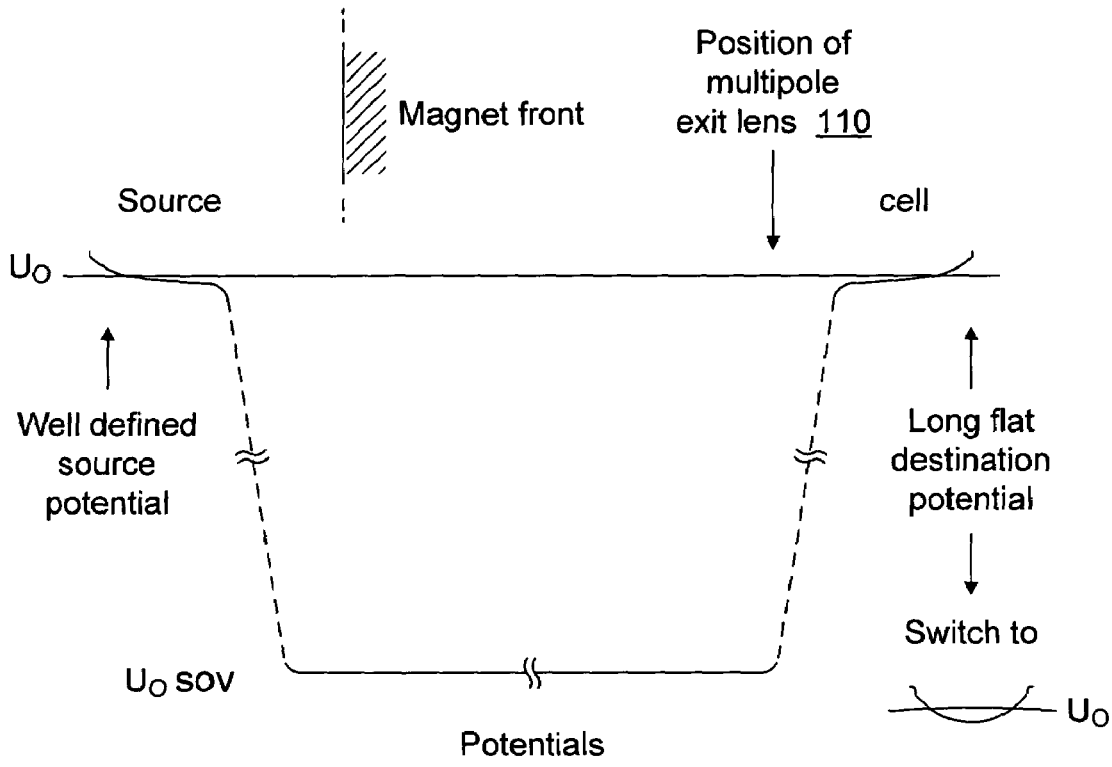
FIG. 7 shows the preferred potential distribution of the system of FIG. 1.

The acceleration potentials of the various stages are shown in FIG. 1 above each stage. It is, of course, to be understood that these potentials are merely exemplary. The potential of the ion trap 30 is 0V, and its length is approximately 50 mm. The potential of the first lens 40 is −5V. The potential of the first multipole ion guide 50 is −10V and this also has a length of approximately 50 mm. The second lens 60 has a potential of −50V, the second multipole a similar potential of −50V (with a length of approximately 120 mm), and the third lens 80 has a potential of −110V. The third multipole ion guide 90 is approximately 600 mm in length and has a potential of −60V. The exit/gate lens 110 has a potential of −8V, and the measurement cell 100 is preferably at 0V, with the electrodes 130 and 131 being at +/−2V respectively. The different voltages on the electrodes in the cell 100 together provide a potential within the cell that has turning points for ions with a certain kinetic energy spread within the cell 100, so that ions at the turning points are at rest and are then accelerated backwards by the potential. This in turn provides sufficient time to close the cell and switch over to ion storage/detection within the cell 100, where a "dish shaped" potential as shown towards the bottom right hand part of FIG. 7 is instead applied. An end face 111 of the measurement cell 100 is held at 2V to provide a trapping potential.

The manner of supply of power to the electrodes in the measurement cell 100 will be described below in particular in connection with FIG. 3.

With the potentials described above, the ions from the source are accelerated and then travel at relatively high energies all the way to the cell 100. The potentials experienced are shown, schematically, in FIG. 7. It will be noted that, in particular, the ions are still travelling with an energy of 50 electron volts as they pass into the magnet and are decelerated with a long, flat deceleration potential at the measurement cell 100.

As an alternative, the ions may be stored in the third multipole ion guide at 0V.

Figure 2A:
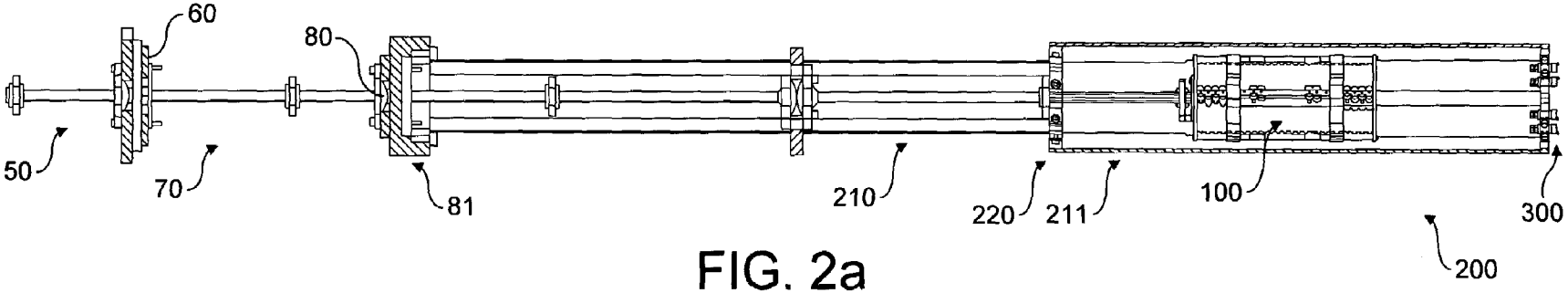
FIG. 2*a* shows a close-up of a part of the system of FIG. 1 in further detail, including the measurement cell but without a vacuum system.

Referring now to FIG. 2*a*, the part of the system from the first multipole ion guide 50 onwards is shown in more detail.

Particularly, FIG. 2*a* shows a support structure 200 for the cell 100 and for the ion transfer optics.

The support structure 200 is formed from a non-magnetic material such as titanium or aluminium. The support structure 200 is mechanically connected to a lens holder 81 which in turn supports the third lens 80. The support structure 200 itself is formed from, in preference, titanium tubes 210, 211 that are interconnected by aluminium spacers 220. Other non-magnetic materials can be employed, but the use of lightweight materials is beneficial as it avoids bending.

FIG. 2*a* also shows a part of an electrical contact system 300 which will be described in connection with FIG. 3 below.

It is important to note from FIG. 2*a* that the cell 100 is supported by the support structure from the injection side, that is, it is cantilevered or otherwise supported from the lens holder 81 (although it could be supported from any other suitable point upstream of the cell). This also helps to improve the accuracy of the alignment of the system. The manner in which the measurement cell 100 may be moved into and out of the superconducting magnet will be explained below in connection with FIG. 4.

Figure 2B:
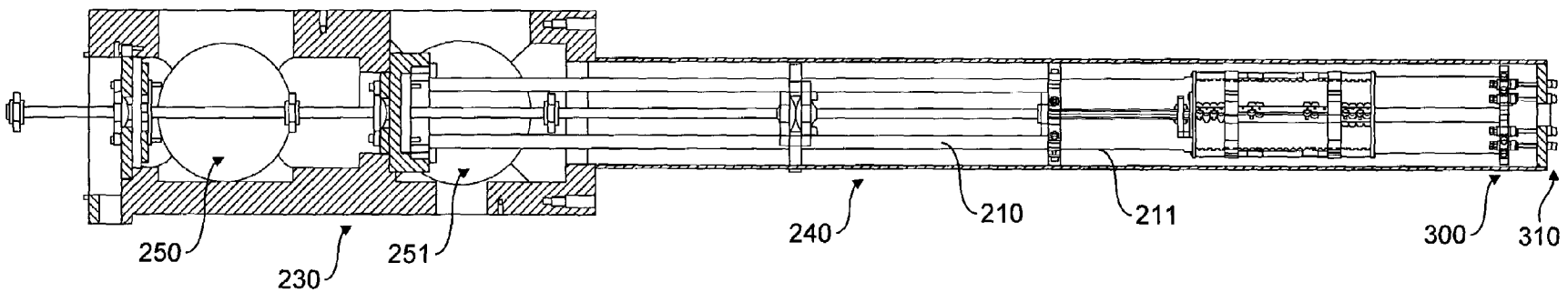
FIG. 2*b* shows the system of FIG. 2*a* but including a vacuum housing.

Referring to FIG. 2*b*, the arrangement of FIG. 2*a* is shown but with various vacuum housings attached. More specifically, a transfer block vacuum chamber 230, which encloses the second lens 60, the second multipole ion guide 70, the third lens 80 and the part of the third multipole ion guide 90 has ports 250, 251 to allow pumping. Alignment of the system is achieved by a mechanical arrangement adjacent the port 251 (not shown in FIG. 2*b*) that allows x-y movement of the measurement cell 100 using levers.

The other important feature to note from FIG. 2*b* is that the inner diameter of the cell 100, relative to the diameter of a cell vacuum chamber 240 in which it is mounted, is large. In other words, there is minimal distance between the inner diameter of the measurement cell 100, and the inner diameter of the cell vacuum chamber 240. The cell 100 shares radial space with the titanium tube 211, which is partially cut away to provide more space for the cell 100 at that point.

With such an arrangement, insertion of the cell 100 into the cell vacuum chamber 240 is more readily achievable from the upstream (injection) side. This avoids the need to construct a flange at the rear (non-injection) side of the measurement cell 100, within the cell vacuum chamber 240.

Figure 3:
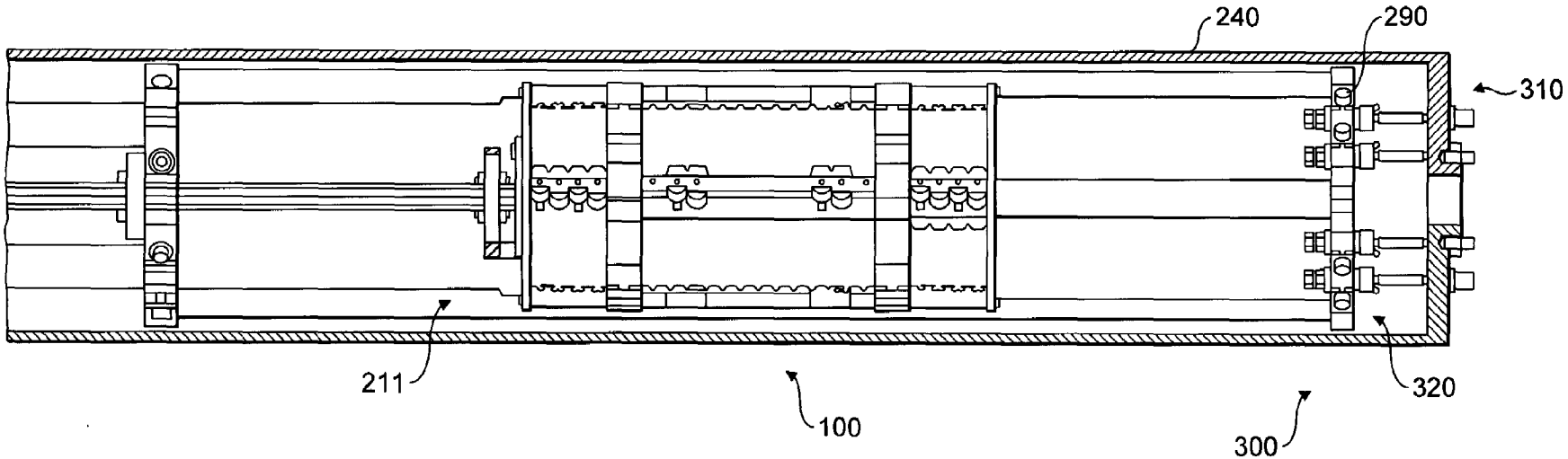
FIG. 3 shows a still further detailed close-up of the measurement cell of FIGS. 1 and 2, as well as the vacuum housing therefore.

Referring now to FIG. 3, a still further close-up of the measurement cell 100 and cell vacuum chamber 240 is shown. It will be seen that the voltage supplied to the cylindrical electrodes (120–140 in FIG. 1) is from the rear (i.e., from the right as viewed in FIG. 3). Electrical contact to the electrodes of the measurement cell 100 is in particular achieved by a rear face which forms a part of the support structure 200. This rear face provides a termination or mounting surface for the titanium tubes 210, 211 and also acts as a terminal block within which are mounted self-aligning contacts 320. These are mounted through the rear face 290 of the support structure 200 and are adapted to engage with corresponding pins or lugs 310 which extend through the rear wall (again as viewed in FIG. 3) of the cell vacuum chamber 240. This arrangement allows electrical contact from outside the system through to the electrodes of the measurement cell and, at the same time, allows mechanical self-alignment of the support structure 200, and hence the measurement cell 100, relative to the cell vacuum chamber 240. The latter, in turn, can be accurately mounted within the magnet (as will be explained in connection with FIGS. 6*a* and 6*b* below), so that the overall alignment of the measurement cell 100 with the magnetic field lines is optimised. A further benefit of having the contacts on the rear side (that is, the side remote from the injection into the measurement cell 100) is that the leads may be relatively short. Making the detection leads (not shown) from the detector to the amplification circuits improves the signal-to-noise ratio for ion detection.

The measurement cell 100 is, in preference, relatively long and in the preferred embodiment has an 80 mm storage region. The magnetic field generated by the magnet (not shown in FIG. 3) is likewise preferably homogeneous over at least that length of 80 mm.

Figure 4:
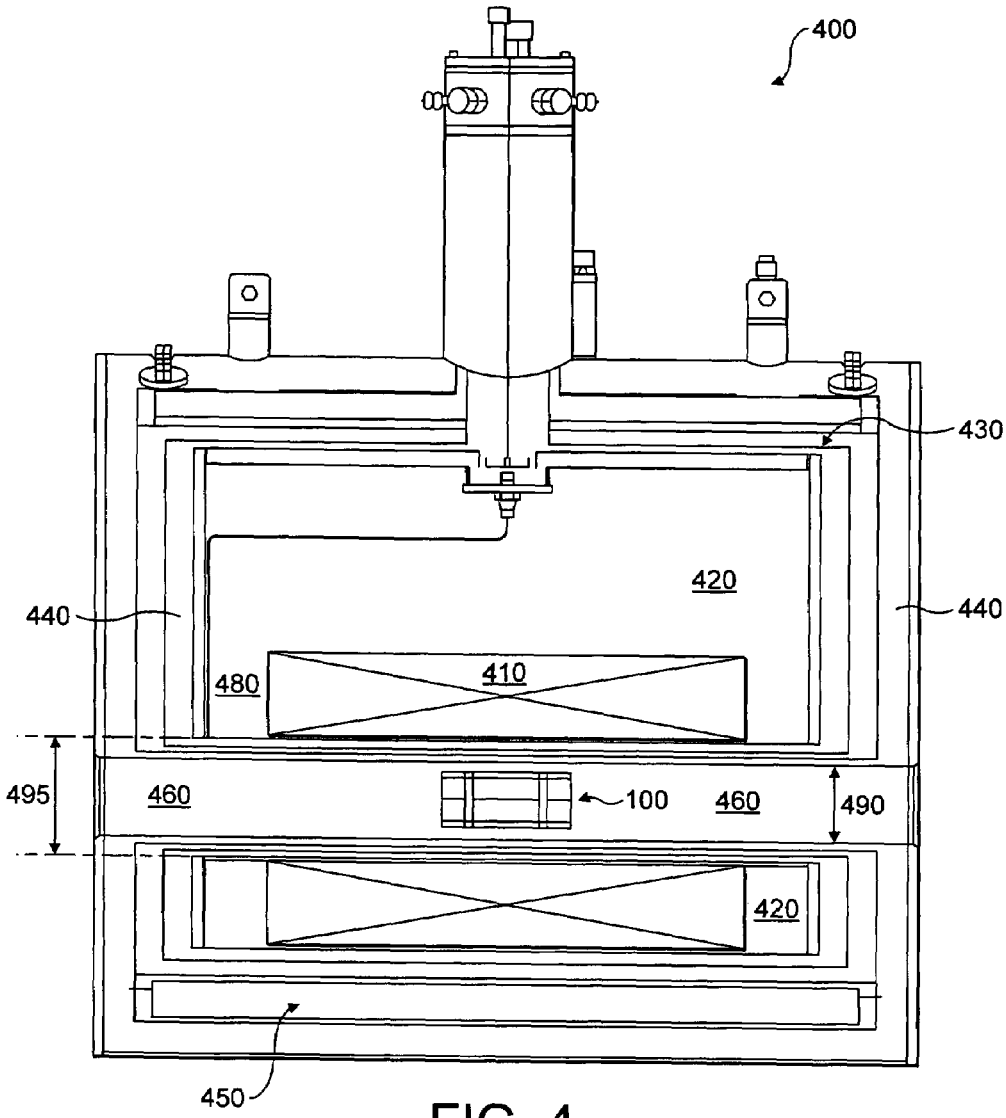
FIG. 4 shows the measurement cell of FIGS. 1 to 3 mounted within a bore of a superconducting magnet.

Referring now to FIG. 4, a schematic drawing of the measurement cell 100 and its location within a superconducting magnet 400 is shown. The superconducting magnet 400 includes a superconducting coil 410, a helium bath 420, a heat shield 430, vacuum insulation 440 and a nitrogen bath 450. All of these features are well known to those skilled in the art and will not be described further.

The cell vacuum chamber 240, support structure 200 and multipole ion guides 50, 70, 90 are not shown in FIG. 4 for the sake of clarity.

Between the front of the magnet coils 410 and the vacuum insulation 440 is a space 480. The coil is preferably moved in the direction of that space 480 so as to shorten the distance from the magnetic centre of the magnet (which coincides with the geometric centre of the measurement cell 100) towards one end of the system. In preference, although not shown in FIG. 4, the magnet is asymmetric so that the length of the magnet may be kept short on the injection side. In particular, it is beneficial that the distance from the front plate to the centre of the magnetic field is less than 600 mm.

The cell 100 (and the cell vacuum chamber 240) are mounted within a bore 460 of a cryostat in which the superconducting magnet sits. The bore 460 has a diameter 490 which is, it will be understood, narrower than the bore 495 of the superconducting coil 410.

Figure 5:
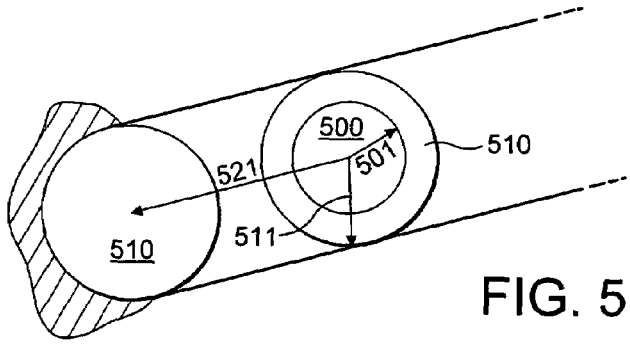
FIG. 5 shows the preferred relative dimensions of the measurement cell and the bore of the superconducting magnet in the axial and radial directions.

FIG. 5 shows the relative areas of the components of FIG. 4. The area of the inner diameter of the measurement cell 100 is shown by region 500. This has a cell radius 501. The inner radius of the magnet (that is, the radius of the magnet bore 490 in FIG. 4) is shown at reference numeral 511 in FIG. 5, and this is the radius of the area 510. Finally, the reference numeral 521 denotes the axial length between the magnetic centre of the magnet (which corresponds with the geometric centre of the measurement cell 100 in preference) to the closer end face of the magnet which is, as explained above, in preference geometrically asymmetric. We define a ratio R which is the ratio of the sectional area within the magnet bore, 510, measured in a plane perpendicular to the longitudinal axis of the magnet bore, relative to the area of the inside of the measurement cell 100 (reference numeral 500 in FIG. 5). For systems with a magnet inner diameter less than 100 mm, it has been found that, especially for preferred cylindrical cells, R should be less than 4.25. In the most preferred implementation, which we currently implement, a cell with an inner diameter of 55 mm and a magnet bore diameter of 95 mm is used, so that R=2.983. Selecting a small R has a particular benefit in conjunction with a short length vacuum system and magnet, for example, there is particular benefit to having a small R and a distance 521 which is less than 600 mm.

For systems with a magnet in a diameter 511 that is between 100 and 150 mm, R should preferably be less than 2.85. Previous systems had R, for example, in excess of 7.

Figure 6A:
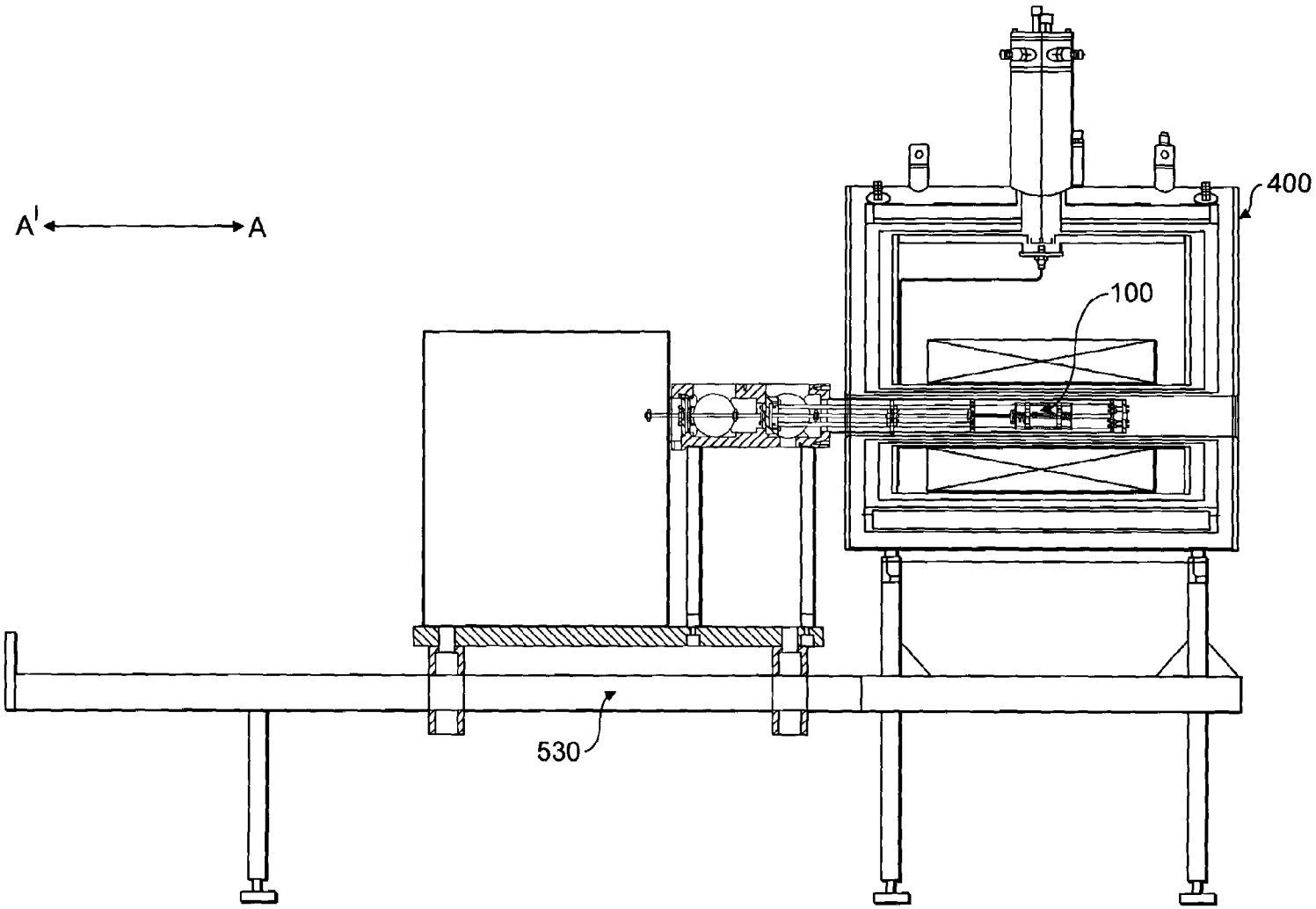
FIGS. 6*a* and 6*b* show a rail arrangement to allow movement of the cell of FIGS. 1 to 4 into (FIG. 6*a*) and out of (FIG. 6*b*) the magnet of FIG. 4.
Figure 6B:
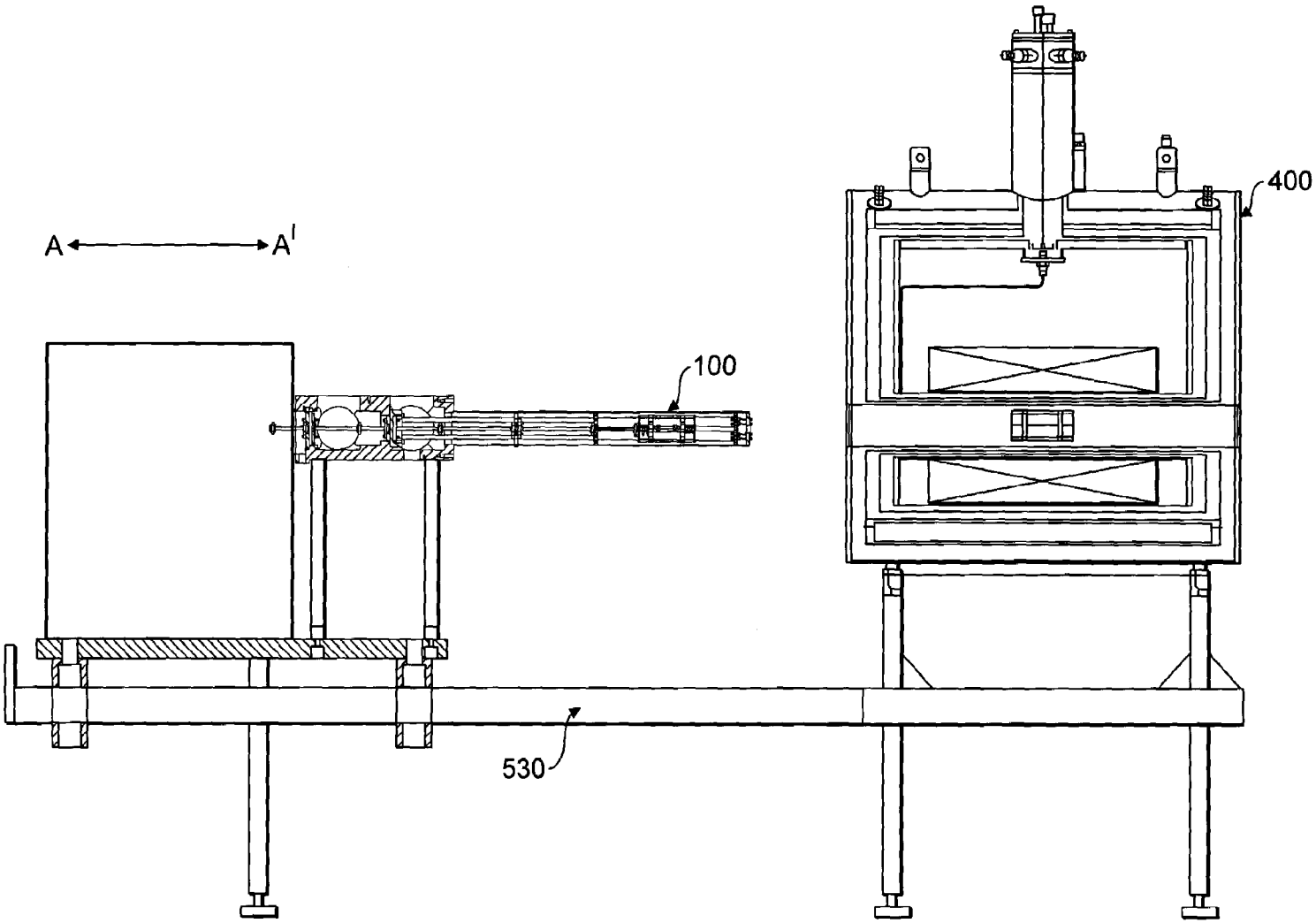

Referring finally to FIGS. 6*a* and 6*b*, a high precision rail system 530 is shown. This supports the system of FIG. 1 (ion source, ion guides, measurement cell and measurement cell support structure) relative to the superconducting magnet 400. The structure can be moved into the room temperature bore of the superconducting magnet 400 in a direction AA' as see in FIGS. 6*a* and 6*b* respectively.

What is claimed is:

1. An ion cyclotron (ICR) mass spectrometer, comprising:

an external ion source arrangement to generate ions to be analysed;

an ion storage device arranged to receive and trap the generated ions;

ion optics arranged between the ion source and the ion storage device to guide the ions as they pass from the source into the storage device;

a measurement cell having cell walls within which is defined a cell volume for receiving ions from the ion storage device, the measurement cell being arranged to be maintained at a pressure lower than that of the ion storage device;

ion guide means arranged between the ion storage device and the measurement cell to guide and focus the ions from the ion storage device into the measurement cell for mass spectrometric analysis therein; and a magnet assembly, including a superconducting magnet which has a room temperature magnet bore arranged to receive the measurement cell, the magnet bore having a longitudinal axis;

wherein the measurement cell extends in the direction of the longitudinal axis of the magnet bore and is generally coaxial therewith, and wherein the superconducting magnet is arranged to generate a magnetic field with field lines that extend in a direction generally parallel with the said longitudinal axis of the magnet bore, and wherein the ratio, R, of the sectional area of the magnet bore to the sectional area of the cell volume, each defined in a plane perpendicular to the said longitudinal axis, is less than 4.25.

2. The mass spectrometer of claim 1, wherein the magnet bore and the measurement cell are each generally right cylindrical, and wherein the diameter of the magnet bore is less than 150 mm.

3. The mass spectrometer of claim 2, wherein the diameter of the magnet bore is greater than 100 mm, and wherein R is less than 2.85.

4. The mass spectrometer of claim 2, wherein the diameter of the magnet bore is less than 100 mm, and wherein the diameter of the inside of the cell walls that define the cell volume is at least 48.6 mm.

5. The mass spectrometer of claim 1, wherein the magnet assembly further includes a housing arranged to receive the superconducting magnet, the housing defining a housing bore which is smaller than the magnet bore, the housing bore being adapted to receive the measurement cell.

6. The mass spectrometer of claim 1, further comprising an evacuable chamber which receives the measurement cell, the evacuable chamber being arranged in use within the magnet bore.

7. The mass spectrometer of claim 1, wherein the axial centre of the measurement cell is arranged away from the geometric centre of the superconducting magnet in the axial direction.

8. The mass spectrometer of claim 7, wherein the superconducting magnet has an asymmetric winding so that the magnetic centre in the direction of the longitudinal axis of the magnet bore is different from the geometric centre in that direction.

9. The mass spectrometer of claim 1, wherein the superconducting magnet is arranged to generate a magnetic field which is substantially homogeneous over a length, in the direction of the longitudinal axis of the magnet bore, of at least 70 mm, and wherein the length of the cell, in that same direction, is likewise at least 70 mm.

10. The mass spectrometer of claim 1, wherein the measurement cell has a front face defining an opening through which the ions are received from an upstream direction, and wherein the measurement cell is cantilevered or supported from a location in that said upstream direction.

11. The mass spectrometer of claim 10, wherein the measurement cell is movable relative to the magnet assembly.

12. The mass spectrometer of claim 1, wherein the measurement cell has a front face defining an opening through which the ions are received from an upstream direction, a rear face opposed to the said front face, a plurality of electrodes to generate an electric field across the cell volume, and detector means, the rear face including at least one external electrical contact adapted to engage with at least one of a corresponding power supply contact and/or detector signal processing means.

13. The mass spectrometer of claim 12, wherein the measurement cell is movable relative to the magnet assembly.

14. The mass spectrometer of claim 1, wherein the power supply is arranged to accelerate the ions to a kinetic energy of in excess of 20 eV for substantially all of the path from the ion trapping device to the said location immediately in front of the measurement cell.

15. The mass spectrometer of claim 14, wherein the power supply is arranged to accelerate the ions to a kinetic energy, E, in excess of 50 eV.

16. A mass spectrometer comprising:

an ion source for generating ions to be analysed;

an ion trapping device to receive the generated ions;

ion optics means to guide the ions from the source into the ion trapping device;

an FT-ICR mass spectrometer having a measurement cell located within a bore of a magnet, the cell being downstream of a front face of that magnet, the FT-ICR mass spectrometer further comprising detection means to detect ions injected into the measurement cells; ion guiding means arranged between the ion trapping device and the FT-ICR mass spectrometer to guide the ions ejected from the trap into the FT-ICR mass spectrometer for generation of a mass spectrum therein; and a power supply for generating an electric field to accelerate the ions between the ion source and the measurement cell;

wherein the power supply is configured to supply a potential which accelerates ions from the source or the ion trapping device to a kinetic energy E and to start to decelerate the said ions only immediately adjacent the front of the measurement cell, and continue to decelerate the said ions at least as far as the front of the measurement cell.

17. The mass spectrometer of claim 16, wherein the power supply is arranged to accelerate the ions to a kinetic energy, E, of in excess of 20 eV for substantially all of the path from the ion source to the said location immediately in front of the measurement cell.

18. The mass spectrometer of claim 16, wherein the power supply is configured to accelerate the ions to the said kinetic energy, E, for at least 90% of the distance from the ion trapping device to the measurement cell, or for at least 90% of the distance from the ion source to the measurement cell.

19. The mass spectrometer of claim 16, wherein the ion guiding means comprises at least one injection multipole ion guide.

20. The mass spectrometer of claim 19, wherein the ion guiding means comprises a plurality of injection multipole ion guides in series with one another.

21. The mass spectrometer of claim 20, wherein each injection multipole ion guide has a longitudinal axis, and wherein the alignment of the axis of each ion guide with a subsequent and/or preceding ion guide is less than about 0.1 mm.

22. The mass spectrometer of claim 19, wherein the multipole ion guide(s) define(s) an inner volume through which the ions pass towards the cell, and wherein the maximum radius of that inner volume of the ion guide(s) is less than 4 mm.

23. The mass spectrometer of claim 22, wherein the multipole ion guide(s) define(s) an inner volume through which the ions pass towards the cell, and wherein the maximum radius of that inner volume of the ion guide(s) is less than 2.9 mm.

24. The mass spectrometer of claim 19, wherein the ion guiding means further comprises at least one lens for focussing the ions.

25. A method of mass spectrometry comprising:

(a) at an ion source, generating ions to be analysed;

(b) guiding the generated ions into an ion trapping device;

(c) ejecting ions from the ion trapping device;

(d) guiding the ions ejected from the ion trapping device into an FT-ICR mass spectrometer which has a measurement cell located within a bore of a magnet, the cell being arranged downstream of a front face of that magnet;

(e) accelerating the ions from the ion source or the ion trapping device to the measurement cell of the FT-ICR mass spectrometer;

(f) starting to decelerate the ions only immediately upstream of the measurement cell, and continuing to decelerate the ions at least as far as the front of the measurement cell; and (g) detecting the ions within the measurement cell.

26. The method of claim 25, wherein the step (e) comprises accelerating the ions to a kinetic energy E in excess of 20 eV.

27. The method of claim 26, wherein the step (e) comprises accelerating the ions to a kinetic energy E in excess of 50 eV.

28. The method of claim 25, wherein the step (e) comprises accelerating the ions to a kinetic energy E for a distance that exceeds 90% of the distance between the ion source and the measurement cell.

29. The method of claim 25, wherein the step (e) comprises accelerating the ions to a kinetic energy E for a distance that exceeds 90% of the distance between the ion trapping device and the measurement cell.

* * * * *